United States Patent [19]

Knott

[11] Patent Number: 4,561,759

[45] Date of Patent: Dec. 31, 1985

[54] DEVICE FOR FILLING AND FILTERING TONER FROM STORAGE CONTAINER INTO A FEED CONTAINER FOR A PHOTOCOPIER

[75] Inventor: Joseph Knott, Tutzing, Fed. Rep. of Germany

[73] Assignee: Siemens Aktiengesellschaft, Berlin & Munich, Fed. Rep. of Germany

[21] Appl. No.: 736,989

[22] Filed: May 23, 1985

Related U.S. Application Data

[63] Continuation of Ser. No. 500,946, Jun. 3, 1983, abandoned.

[30] Foreign Application Priority Data

Jun. 29, 1982 [DE] Fed. Rep. of Germany ..... 3224296

[51] Int. Cl.[4] ..... G03G 15/06

[52] U.S. Cl. ..... 355/3 DD; 222/200; 222/DIG. 1

[58] Field of Search ..... 355/3 DD, 14 D; 118/653; 222/199, 200, DIG. 1

[56] References Cited

U.S. PATENT DOCUMENTS

| | | | |
|---|---|---|---|
| 2,904,000 | 9/1959 | Fisher et al. | 355/3 DD |
| 3,883,240 | 5/1975 | Ito et al. . | |
| 3,958,878 | 5/1976 | Smith et al. | 355/15 |
| 4,046,468 | 9/1977 | Stryjewski | 355/15 X |

*Primary Examiner*—A. T. Grimley
*Assistant Examiner*—J. Pendegrass
*Attorney, Agent, or Firm*—Hill, Van Santen, Steadman & Simpson

[57] ABSTRACT

A device for filling and filtering toner from a supply container which is placed by an operator in communication with a feed container in a photocopier has a cylindrical filling opening for the feed container with a cross section such that the supply container can be inverted therein, and has a filter basket disposed in the region of the filling opening which is closed from the feed container by a filter mesh, and an electric vibrator connected thereto by a linkage which can be automatically triggered at the beginning of a filling operation.

7 Claims, 2 Drawing Figures

DEVICE FOR FILLING AND FILTERING TONER FROM STORAGE CONTAINER INTO A FEED CONTAINER FOR A PHOTOCOPIER

This is a continuation of application Ser. No. 500,946, filed June 3, 1983 now abandoned.

BACKGROUND OF THE INVENTION

1. Field of the Invention

The present invention relates to means for supplying toner to photocopier devices, and in particular to a means for simultaneously filling and filtering the toner from a supply container into the feed container.

2. Description of the Prior Art

In xerography and modern high-speed data printers which operate in accordance with the principle of electrophotography, charge images are produced on a data carrier, for example, directly upon an intermediate carrier (photoconductive drum) or directly upon special paper, and are subsequently colored with a black powder (toner) in a developing station. When an intermediate carrier is used this toner image is then transferred to normal paper to which it is fixed. Generally a two-components developer composed of ferromagnetic carrier particles and toner particles is used for developing purposes. With the aid of a magnetic brush arrangement the developer is conducted past the charge image on the intermediate carrier to which the toner adheres as a result of electrostatic forces. An electro photographic copier which developes charge images in accordance with the described principle is disclosed, for example, in German As No. 21 66 667 corresponding to U.S. Pat. Nos. 3,784,297 and 3,883,240.

The coloring of the charge images of the intermediate carriers results in a continuous reduction in the toner concentration in the developer mixture in the developing station. Therefore it is necessary to continuously supply the developer mixture with dispensations of fresh toner. Because the toner consumption per time unit is extremely high in high-speed copiers and high-power data printers, such devices use a large volume toner feed container in order to avoid periods of inactivity during the refilling of toner. When the toner feed container becomes empty, the toner, which is usually supplied in managable containers, is filled into the feed container. When this takes place it is important that the toner should be transferred from the container into the feed container in such a way that no toner reaches the outside of the feed container.

For this purpose it has been proposed that the filling opening of the feed container should be shaft-like and should possess a cross-section which is such as to allow the upper part of the container, which contains the outlet openings, to be inverted into the filling opening.

A disadvantage of a device of this kind is that the bottles of toner must be emptied into the toner feed container by hand by means of shaking and tapping. Due to the unfavorable pouring properties of the toner, the operator must expend a considerable amount of time and labor in emptying the supply bottles. Furthermore, in the event of inefficient emptying, when the quantities involved are often considerable, residues of toner remain in the bottles. In addition it is possible for impurities of all sorts and sizes to enter the developing station through the filling openings of the toner feed container. Impurities present in the developer in the developing station can negatively influence the printed image and represent a high risk factor as regards damage to the photoconductive drum.

SUMMARY OF THE INVENTION

It is an object of the present invention to provide a device for filling toner from a container into a feed container which facilitates automatic, full emptying of the container and which additionally prevents impurities from reaching the developing station.

The above object is inventively achieved in a feed container having a cylindrical shaft-like opening which receives an inverted supply container. The filling opening for the feed container has a basket having a filter mesh at a lower portion thereof through which the toner must pass before entering the feed container. The basket is pivotally mounted and is supported at its upper rim by a resilient ring which also serves as a seal. The basket is connected to a vibrator means, which may be automatically triggered upon the opening of the cover for the feed container at the beginning of a filling operation. The vibrator rapidly shakes the basket, causing movement about its pivot mountings, thereby shaking the toner through the filter mesh, which prevents oversize and unwanted particles from entering the feed container for subsequent use in the copying process.

The invention not only permits an automatic emptying of the bottle of toner by virtue of a vibration process but also allows a filtering of the toner as it enters the toner feed container.

Furthermore the device prevents undesirable alien components, from a specific size upwards, from passing through the individual opening of the toner feed container into the printing cycle where they may negatively influence the printed image or damage the photoconductive drum.

DESCRIPTION OF THE PREFERRED EMBODIMENTS

Figures 1, 2:
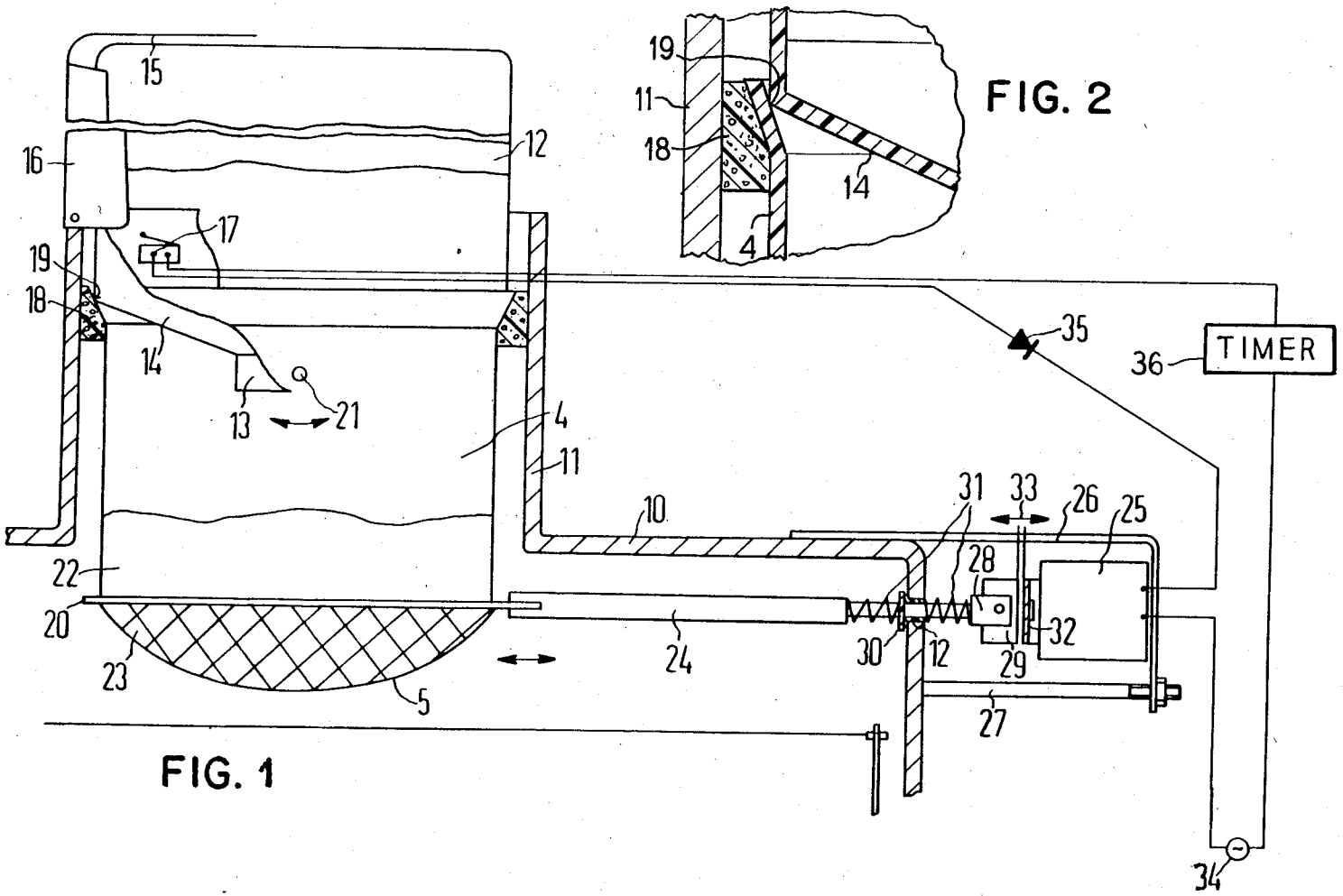
FIG. 1 is a side view, partly in section and partly broken away, of a device for filling and filtering toner constructed in accordance with the principles of the present invention.
FIG. 2 is an enlarged detail in section of a portion of the device of FIG. 1.

The portion of a laser printer shown in the drawing has a toner feed container 10 from which the toner is conveyed to a developing station which serves to develop charge images. The toner feed container 10 has a shaft-like cylindrical filling opening 11 whose cross-section is such that the upper part 14 which contains an outlet opening 13 of a container 12 can be inverted into the filling opening 11. For this purpose, the upper edge of the filling opening 11 there has a hinged cover 15 which is provided with guides 16 cooperating with a contact 17 arranged at the upper edge of the filling opening 11 and which accommodates the container 12.

In the vicinity of the upper component of the filling opening 11, a ring 18 consisting of elastic material is arranged as a seal.

Inside the filling opening 11 there is arranged a filter basket 20 which is pivotally mounted in the filling opening 11 by means of bearing pins 21 and which consists of a tubular filter basket housing 4 abutting against the ring of elastic material 18 (see FIG. 2) which may be, for example, foam rubber, and a filter 5.

The housing 4 is shown partly broken away to reveal the container parts 13 and 14, also partly broken away.

Via a linkage 24 the filter basket is connected to a vibrator which can be operated by the switching contact 17. This vibrator consists of an alternating current driven oscillating magnet 25 which is permanently connected to the toner feed container 10 by a support clip 26. The support clip 26 is attached to the toner feed container 10 by an adjusting screw 27.

Opposite the oscillating magnet 25, supported by an oscillator holder 28 arranged on the linkage 24, is arranged an oscillator 29. The linkage moves through a synthetic guide bushing 30 in a side wall of the toner feed container 10 against the bias of two springs 31.

A working air gap 33, which can be seen between the oscillator 28 and a felt coating 32 on the oscillating magnet 25 which serves as damping plate, can be adjusted by means of the adjusting screw 27.

The device operates as follows. When the cover 15 of the toner feed container 10 is opened, the switch 17 closes a circuit causing the oscillating magnet 25 of the vibrator to be connected to an alternating current source 34. A diode 35 arranged in the circuit produces an oscillating frequency of 50 Hz in the oscillating magnet, or when no diode is provided the oscillating frequency amounts to 100 Hz. Through the oscillator 29 and the linkage 24, the oscillating magnet 25 sets the filter basket 20 in oscillation, and fine adjustment of the oscillating amplitude is effected by the adjusting screw 27. In order to ensure that the oscillation amplitude is sufficiently high at the point of contact 19 between the housing 4 and the upper part of the container 12, the point 19 permitted by the elastic ring 18 lies approximately 20 to 30 mm below the upper edge of the filter basket. As a result of the oscillations of the filter basket 20 permitted by the elastic ring 18, the container 12 which is to be emptied is likewise set in oscillation at the funnel-shaped edge 19, and as a result of these vibrations the toner in the bottle is discharged entirely from the container 12 within approximately 30 to 60 seconds and in so doing falls into the belly-like filter 5 of the filter basket. In accordance with the size of the components of the two-component developer mixture, the filter 5 has a mesh width of approximately 0.2 to 0.5 mm with a wire thickness of 0.1 to 0.20 mm. The belly-like formation of the filter 5 facilitates a maximum throughput of toner. As a result of the filtering process which takes place simultaneously with the emptying of the container 12, the filtered toner enters the toner feed container 10. Particles which are greater in size than the filter mesh width are retained in the filter basket. Periodically they must be removed, for example, by suction. In order to avoid overfilling the filter basket, the throughput of toner during the filter process must be greater than or equal to the quantity discharged from the container 12 per time unit. The ring 18 composed of elastic material, which is applied to the continuous edge between toner feed container and filter basket, prevents toner dust escaping from the toner feed container during the vibration and filter process, positions the filter basket, and acts as a silencer. At the same time the ring 18 transfers the vibratory motion of the filter basket to the container 12.

In order to further automate the vibration process, it is possible to provide a timer 36 (which may be combined with the switch 17) which limits the vibration process, for example, to one minute.

Although modifications and changes may be suggested by those skilled in the art it is the intention of the inventor to embody within the patent warranted hereon all such changes and modifications as reasonably and properly come within the scope of his contribution to the art.

I claim as my invention:

1. In a non-mechanical printer or copier having a feed container therein and a filling opening for receiving an inverter toner storage container for emptying said toner from said storage container into said feed container, the improvement comprising:

a basket pivotally mounted in said filler opening having an upper basket housing with an outwardly slanted lip with an upper rim, said upper rim disposed for removably contacting only an edge of said storage container inverted in said filling opening at a distance below said upper rim, and having a lower basket filter connected to said upper basket housing onto which toner from said storage container is emptied;

an elastic ring seal surrounding an exterior of said upper rim and resiliently connecting said rim to said filling opening and simultaneously sealing said filling opening; and a means for oscillating said basket about the pivotal mounting for assisting emptying of toner from said storage container and for assisting transfer of said toner through said basket filter.

2. The improvement of claim 1 wherein said upper basket housing is a tubular portion extending through and pivotally mounted in said filling opening, and wherein said basket filter is a mesh disposed at a bottom of said tubular portion so as to hang therefrom.

3. The improvement of claim 1 further comprising a cover for said filling opening and a trigger means disposed in the region of said filling opening for automatically triggering said means for oscillating for vibrating said basket when said cover is opened.

4. The improvement of claim 3 further comprising a timer means interconnected between said trigger means and said means for oscillating for permitting vibration of said basket for a specified period of time after said trigger means is activated.

5. The improvement of claim 1 wherein said means for oscillating comprises:

an oscillating magnet;

an adjustable support means permanently connecting said oscillating magnet to said feed container;

an oscillator connected to said basket through a linkage moving longitudinally with respect to said filling opening; and a spring connected to said linkage for biasing said oscillator so as to form a working air gap with said oscillating magnet.

6. The improvement of claim 5 further comprising a means for adjusting the width of said working air gap.

7. The improvement of claim 6 wherein said means for adjusting the width of said working air gap comprises an adjustment screw abutting a housing for said feed container.

* * * * *